US006010275A

United States Patent [19]

Fitch

[11] Patent Number: 6,010,275

[45] **Date of Patent: *Jan. 4, 2000**

[54] COMPRESSION GUARDRAIL

[76] Inventor: John C. Fitch, 433 Salmon Kill Rd., Lime Rock, Lakeville, Conn. 06039

[ * ] Notice: This patent issued on a continued prosecution application filed under 37 CFR 1.53(d), and is subject to the twenty year patent term provisions of 35 U.S.C. 154(a)(2).

[21] Appl. No.: 08/917,201

[22] Filed: Aug. 25, 1997

[51] Int. Cl.[7] ..... E01F 15/00

[52] U.S. Cl. ..... 404/6; 256/13.1

[58] Field of Search ..... 404/6, 7, 9; 256/1, 256/13.1, 64

[56] References Cited

U.S. PATENT DOCUMENTS

| | | | |
|---|---|---|---|
| 1,600,165 | 9/1926 | Dennebaum | 256/1 X |
| 3,369,634 | 2/1968 | Mazelsky . | |
| 3,436,057 | 4/1969 | Mazelsky . | |
| 3,467,361 | 9/1969 | Moschettini . | |
| 3,567,184 | 3/1971 | Yancey . | |
| 3,606,258 | 9/1971 | Fitch | 256/13.1 |
| 3,690,619 | 9/1972 | Kendall . | |
| 3,848,853 | 11/1974 | Way et al. . | |
| 4,090,694 | 5/1978 | Vincent | 256/13.1 |
| 4,288,061 | 9/1981 | Moreau . | |
| 4,348,266 | 9/1982 | Coran et al. | 204/159.17 |
| 4,662,611 | 5/1987 | Ruane | 256/13.1 |
| 4,674,911 | 6/1987 | Gertz | 256/13.1 X |
| 4,784,515 | 11/1988 | Krage et al. . | |
| 5,125,762 | 6/1992 | Strassil | 256/1 X |
| 5,238,228 | 8/1993 | Moon . | |
| 5,314,261 | 5/1994 | Stephens | 256/13.1 X |
| 5,316,815 | 5/1994 | Tripp . | |
| 5,378,088 | 1/1995 | Foehrkolb . | |
| 5,403,112 | 4/1995 | Carney, III | 404/6 |
| 5,568,913 | 10/1996 | Nagler | 256/13.1 |
| 5,607,252 | 3/1997 | Tischer | 256/13.1 X |
| 5,645,368 | 7/1997 | Yunick . | |
| 5,660,496 | 8/1997 | Muller et al. | 256/13.1 X |
| 5,720,470 | 2/1998 | Johansson | 256/13.1 |

OTHER PUBLICATIONS

"React 350, Reusable Energy Absorbing Crash Terminal", (undated), 6 pages.

*Primary Examiner*—David Bagnell
*Assistant Examiner*—Sunil Singh
*Attorney, Agent, or Firm*—David A. Tamburro

[57] ABSTRACT

An impact attenuating guardrail including a rail extending longitudinally along a roadway, a plurality of fixed support posts spaced behind the rail, and resilient compressible energy absorbing means mounted between the rail and the posts.

3 Claims, 3 Drawing Sheets

COMPRESSION GUARDRAIL

BRIEF DESCRIPTION OF THE INVENTION

This invention relates generally to guardrails extending along a roadway, particularly a race track, for redirecting an errant race car back onto the track. More particularly, it is directed to a novel resiliently mounted guardrail capable of redirecting a race car with no or little decelerating effect and with minimal or no damage to the car.

Race tracks are commonly lined with protective barriers such as concrete walls, fixed guardrails including standard metal W-beams and/or tire walls, i.e. bundles of tires tied together and stacked in front of the walls and the unyielding guardrails. When a car impacts against a concrete wall or an unyielding guardrail, even at a shallow angle, the car can experience significant deceleration and damage and the driver risks serious injury. Tire walls have been placed in front of these immovable barriers in an effort to soften the impact of the errant car, reduce the damage thereto, and redirect it back onto the track. However, when hit at a shallow glancing angle at racing speeds of up to about 200 mph, the tire walls can snag the car and violently reject it back into the stream of traffic, creating a dangerous situation for all drivers.

SUMMARY OF THE INVENTION

Accordingly, it is a primary object of this invention to overcome the deficiencies of the above described conventional barriers by providing a compressible resilient guardrail which, upon impact by a car,. effectively intercepts and redirects the car with significantly reduced damage to the barrier, to the car, and risk of injury to the driver.

The novel guardrail barrier of the invention achieves its objectives by providing one or more longitudinally extending vehicle interfacing members or rails, e.g. standard metal W-beams, and a plurality of compressible, resilient energy absorbing members positioned between the beams and standard fixed guardrail support posts or a concrete wall. Upon impact, the beams move with the car, absorbing energy and reducing damage to the car and the beams. Snagging is prevented and the intended function of a guardrail is restored—that of redirecting the race car with little decelerating effect. Significantly, the barrier affords these advantages at low cost.

The compression guardrail barrier of the invention can be advantageously used where space is limited. The barrier provides a soft alternative to rigid perimeter walls on oval tracks lined with unyielding concrete, or on any race circuit where run-off space is restricted or where grandstands, pits or other spectator participant areas must be protected.

Other objects and advantages will become apparent from reading the following detailed description of the invention wherein reference is made to the accompanying drawings.

DETAILED DESCRIPTION OF THE INVENTION

Figure 1:
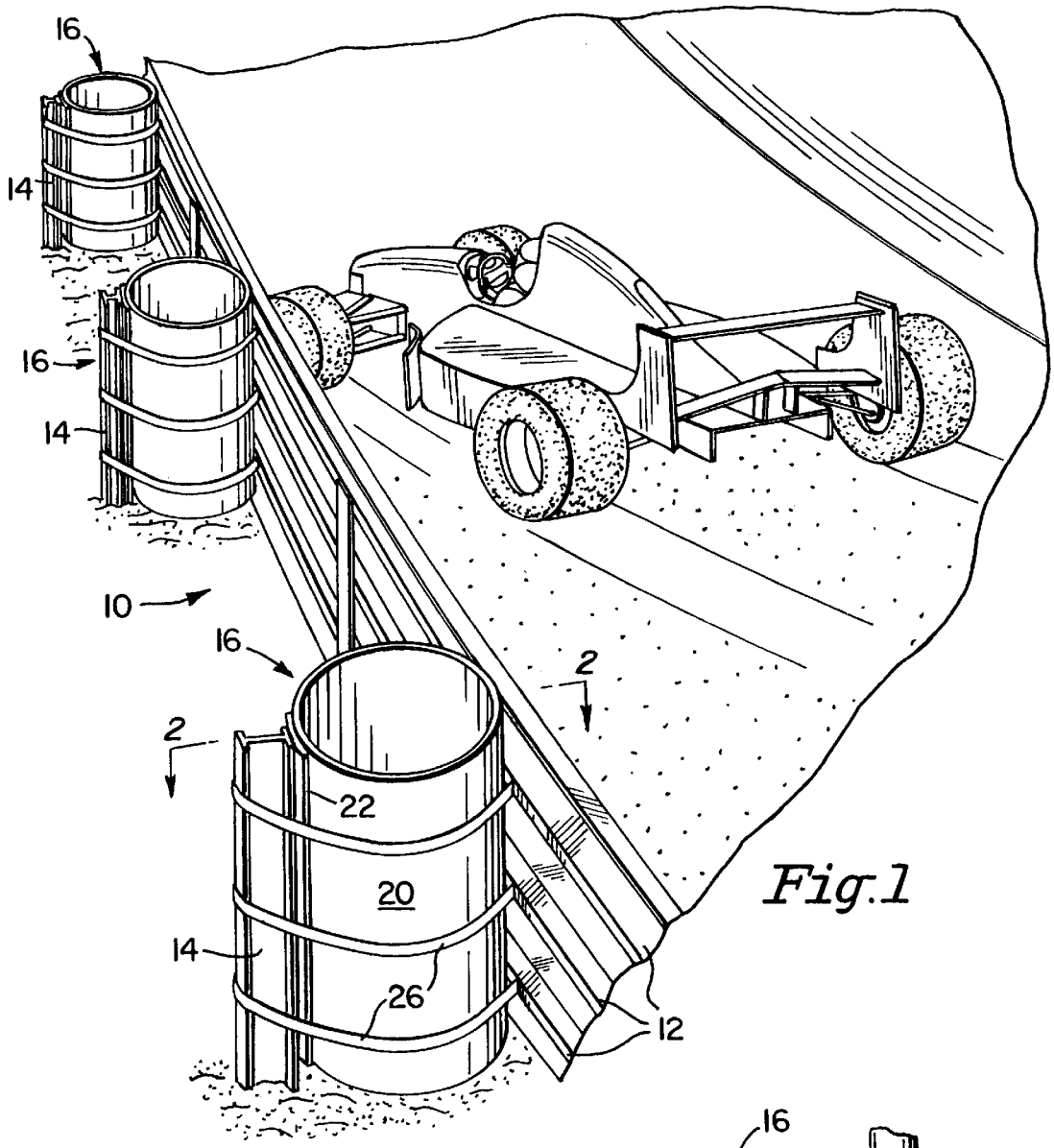
FIG. 1 is a general perspective view of the compressible guardrail of the invention extending along the side of a race track.
Figure 2:
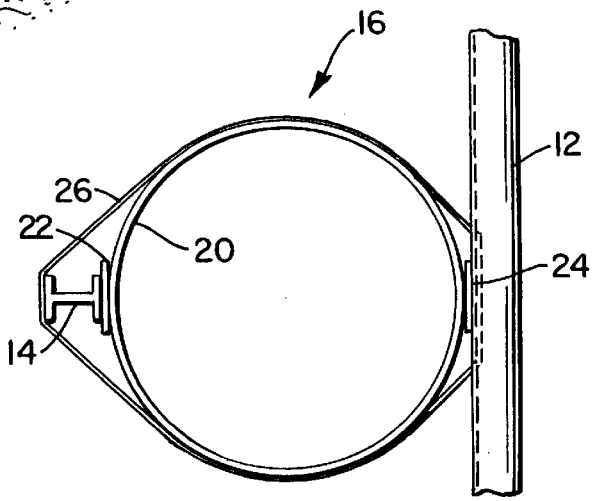
FIG. 2 is a top view taken along line 2—2 of FIG. 1.
Figure 3:
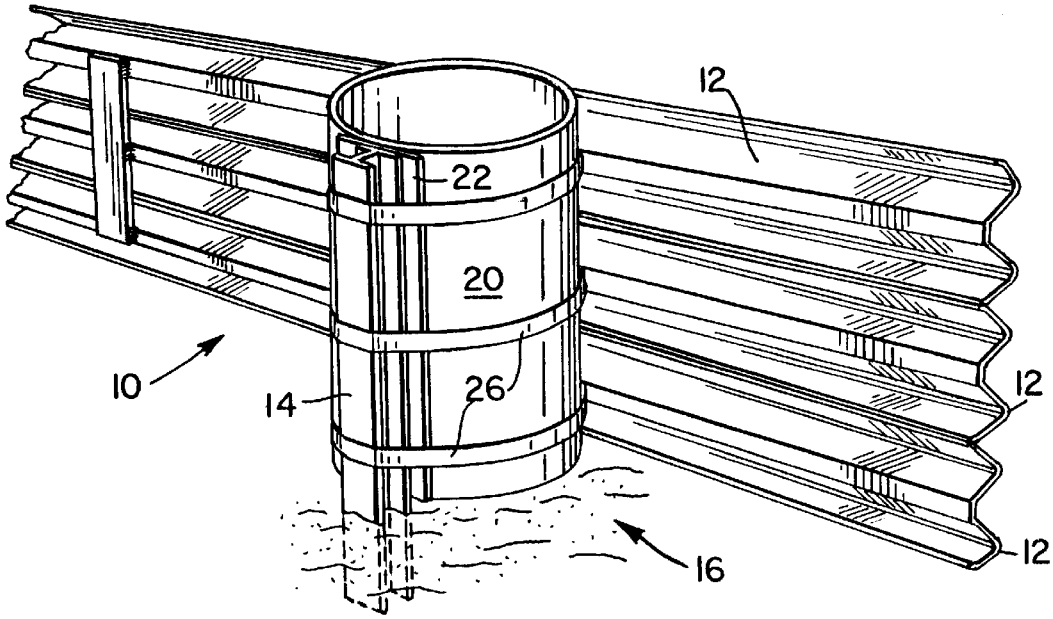
FIG. 3 is a fragmentary sectional view from the back side of the guardrail illustrating a preferred form of the resilient energy-absorbing mounting assemblies.
Figure 4:
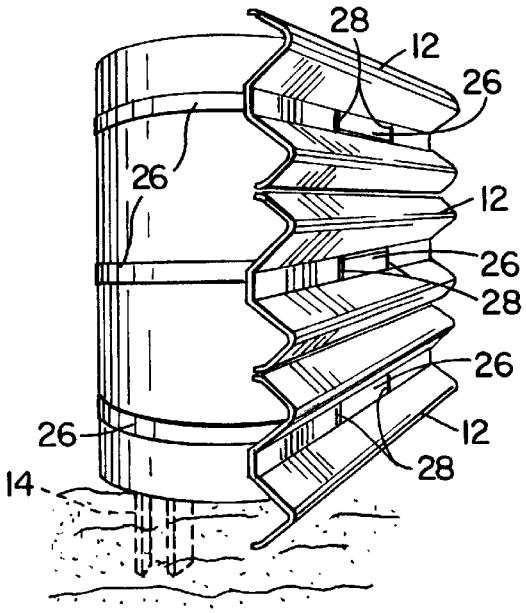
FIG. 4 is a view similar to FIG. 3, but from the front track side of the guardrail.

As illustrated in the drawings, the guardrail barrier 10 of the invention comprises longitudinally extending rails 12, formed e.g. by standard rigid metal W-beams stacked 3 high, a plurality of longitudinally spaced vertical metal I-beam posts 14 fixed in the ground and spaced rearwardly from rails 12, and a compressible resilient energy absorbing assembly 16 mounted within the space between each post 14 and rails 12.

Each assembly 16 includes one or more compressible, resilient, self-restoring plastic cylinders 20 mounted vertically between a flat tie bar 22 attached to post 14 and a second flat tie bar 24 attached to rails 12. A plurality of suitable straps 26 pass through slots 28 in rails 12 and wrap around and secure rails 12 and cylinder 20 to post 14. Cylinder 20 may be of the type known as a REACT (Reusable Energy Absorbing Crash Terminal) cylinder sold by Roadway Safety Service, Inc. of Ronkonkoma, N.Y. Each cylinder 20 is of high molecular weight, high density HMW/HDPE polyethylene, and may be about 3 feet in diameter, with a wall thickness within the range of 0.80 to 1.85 inches.

Upon impact of an errant car with rails 12, the cylinders 20 adjacent the area of impact will be compressed or flattened, allowing rail 12 to be displaced outwardly away from the track in the direction of movement of the errant car. This movement absorbs some or all of the impact energy, reducing damage to the car and rails 12, and the rails redirect the car with no snagging back toward the track with little or no deceleration.

Following the impact, cylinders 20 return to their original diameter, restoring rails 12 to their normal position.

Figure 5:
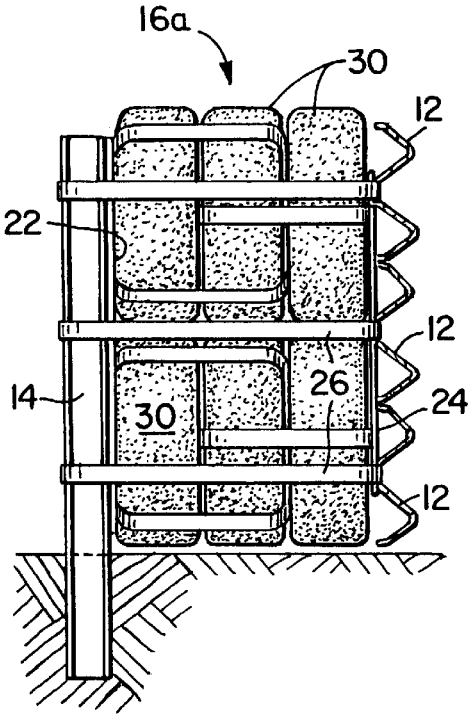
FIG. 5 is an end view of an alternative resilient mounting assembly.

Referring to FIG. 5, another form of an energy-absorbing assembly 16*a* includes a plurality of used rubber tires 30 bundled three together side-by-side and stacked two bundles high for axial compression, the tires replacing cylinders 20 of FIGS. 1–4. To enhance and stabilize the compression rate of the tires, the tires may be filled with foam.

Figure 6:
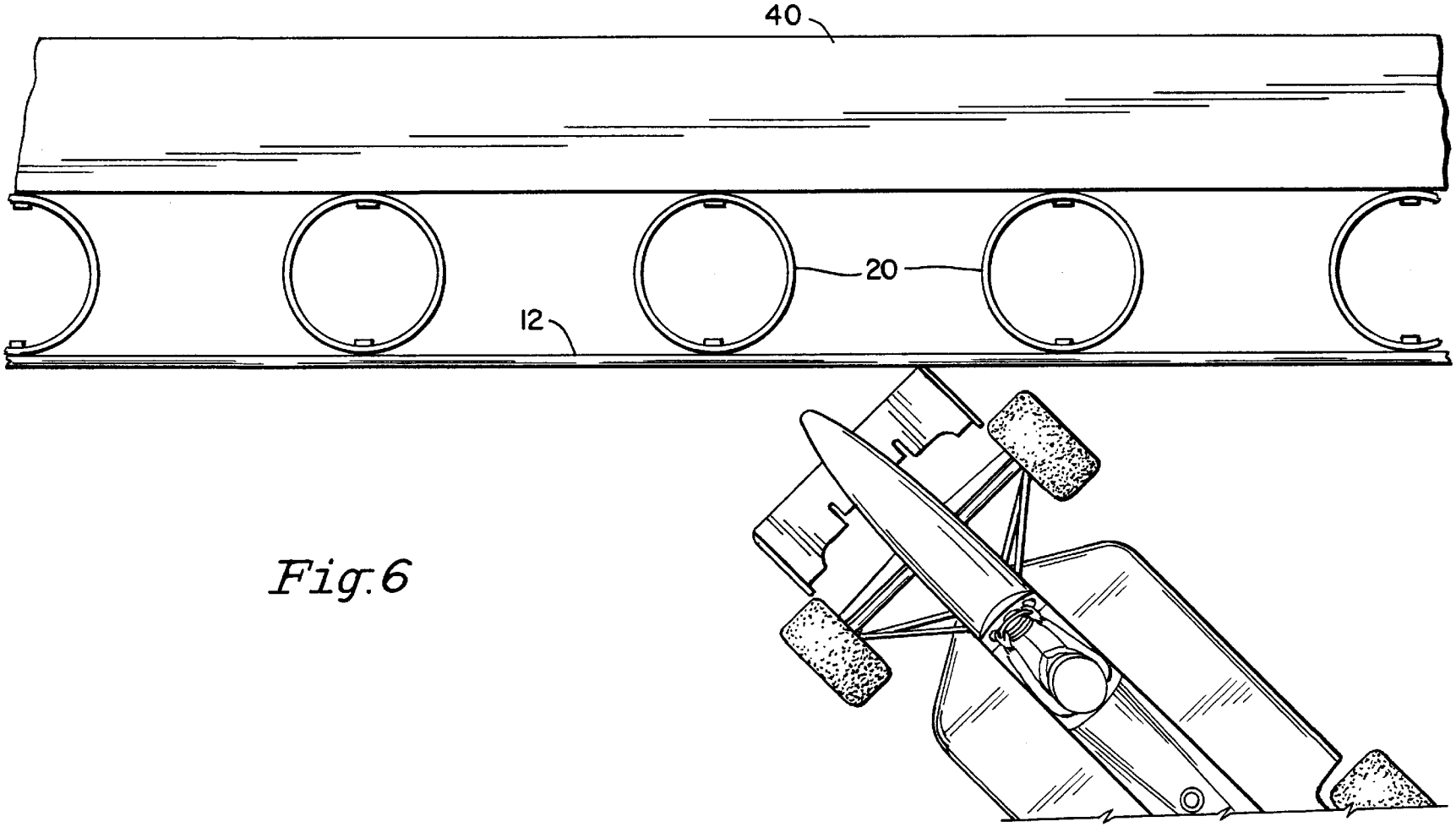
FIG. 6 is a view similar to FIG. 1 but illustrating the compressible guardrail of the invention used in conjunction with a concrete wall.

In another modification illustrated in FIG. 6, the compression guardrail of the invention may be used in conjunction with other fixed barriers or obstacles such as a concrete wall 40 rather than posts 14.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. An impact attenuating guardrail comprising rail means extending longitudinally along a roadway and having a substantial vertical height at least equal to the height of the center of gravity of an errant vehicle leaving the roadway at a high speed, said rail means adapted to intercept and redirect the errant vehicle back onto the roadway, fixed obstacle means spaced from said rail means, energy absorbing means mounted between said rail means and said obstacle means permitting displacement of said rail means away from the roadway upon impact by said errant vehicle, said energy absorbing means including at least one resilient cylindrical member of high molecular weight, high density polyethylene and having a vertical height sufficient to support said rail means substantially throughout its vertical height.

2. The guard rail defined in claim 1, said obstacle means comprising a plurality of longitudinally spaced vertical posts, and said energy absorbing means comprising at least one resilient cylindrical member mounted between each of said posts and said rail means.

3. The guardrail defined in claim 1, said obstacle means being a wall, and said energy absorbing means comprising a plurality of said resilient cylindrical members mounted along said rail means between said rail means and said wall.

* * * * *